US006889028B1

(12) United States Patent
Hunold et al.

(10) Patent No.: US 6,889,028 B1
(45) Date of Patent: May 3, 2005

(54) TECHNIQUE AND DEVICE FOR CONTROLLING THE POSITION ACCURACY IN COLOR PRINTING

(75) Inventors: Heiko Hunold, Wattenbek (DE); Wolfgang Eberhard Luxem, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/458,543

(22) Filed: Jun. 10, 2003

(30) Foreign Application Priority Data

Jul. 15, 2002 (DE) ..... 102 31 801

(51) Int. Cl.[7] ..... G03G 15/01
(52) U.S. Cl. ..... 399/301
(58) Field of Search ..... 399/38, 39, 40, 399/41, 46, 49, 297, 298, 301; 358/1.9, 526; 347/116

(56) References Cited

U.S. PATENT DOCUMENTS 5,457,518 A * 10/1995 Ashikaga et al. ..... 399/28
5,510,885 A * 4/1996 Mori et al. ..... 399/28
6,603,574 B1 * 8/2003 Ramirez et al. ..... 358/1.9

FOREIGN PATENT DOCUMENTS

| | | |
|---|---|---|
| EP | 1 156 384 | 11/2001 |
| JP | 06040605 | 2/1994 |

* cited by examiner

*Primary Examiner*—Hoan Tran
(74) *Attorney, Agent, or Firm*—Lawrence P. Kessler

(57) ABSTRACT

Controlling the position accuracy in color printing with an electrophotographic printing device in regard to the register, namely the position accuracy of a printed image on the print substrate, in particular on the printed sheet regarding an edge of the printed sheet and in regard to the gage-pin, namely the position accuracy of the color printouts of the color print in relation to each other. Register and gage-pin position accuracy are executed with one and the same sensor unit, having one light receiver (sensor), which receives light from at least one light emitter. In this way, both of the position accuracy can be checked economically while saving space and in extreme cases, be corrected, preferably using a control fitting.

9 Claims, 1 Drawing Sheet

TECHNIQUE AND DEVICE FOR CONTROLLING THE POSITION ACCURACY IN COLOR PRINTING

FIELD OF THE INVENTION

The invention relates in general to controlling position accuracy in color printing with an electrophotographic printer device in regards to the register, namely the position accuracy of a printed image on the print substrate, in particular, a printed sheet regarding the edge of the printed sheet and in regard to the gage-pin, namely the position accuracy of the color printouts, of the color print to each other.

BACKGROUND OF THE INVENTION

When printing with a printer, the register and gage-pin must be monitored and calibrated. In particularly, the gage-pin can be calibrated in an electrophotographic printer by the positioning description of a photoconductor.

To control the gage-pin, color register marks are normally printed on a print substrate or transparent transport band for the print substrate, and by the individual printing jobs in order to print the different color printouts, preferably in cyan, magenta, yellow and black for a multi-color printout for example. A sensor allows the positions of these color register marks to be set relative to each other. To do this, the sensor emits light and receives light, which is reflected back into the sensor by the area around each color register mark, namely by the print substrate or a reflector arranged on the other side of the transport band, which is transparent for the light. Here, the absorption of the light in the area of the color register mark is itself greater than in its own vicinity, so that a contrast is created, which allows the sensor to recognize at least one edge of the color register mark in the working field of the sensor.

To check the register, an edge of a print substrate must be recognized, onto which the printed image is supposed to be printed on the print substrate. Preferably, the front edge of a printed sheet in the sheet transport direction will be ascertained by doing this. Normally, a light barrier is used for this, where a light emitter is arranged on one side of the transparent transport band for the print substrate, preferably underneath the transport band and light is sent through the transport band to a light receiver on the other side of the transport band. This light path is first partially and then completely broken by the arrival of a printed sheet, whereby the edge of the printed sheet can be localized within the working area of the light barrier.

SUMMARY OF THE INVENTION

This invention is to make ascertaining the above-mentioned position accuracy more cost effective and simpler. This is achieved so that both types of position accuracy mentioned (register and gage-pin), can be executed with one and the same sensor unit, including a light receiver (sensor), which receives the light of at least one light emitter. In this way, both position accuracy methods mentioned can be checked economically and saving space, and if necessary, corrected, preferably using a control unit.

The sensor unit used will be operable so that it can be used in two operating modes, for which at least two light emitters will be available, whereby in one of the operating modes light from the first light emitter will be transmitted to the light receiver through a transparent carrier or a transparent transport band for the print substrate and the first light emitter and the light receiver are arranged on different sides of the transparent carrier; in the other operating mode light from the second light emitter is reflected to the light receiver and the second light emitter and the light receiver are arranged on the same side of the transparent carrier.

The single sensor unit can therefore perform both functions of the method described with its two operating modes, namely working as a light barrier and as a reflector. In this context, it should be mentioned that the light barrier mode can also be used for color register marks on a transparent transport band.

From the point of view of the device, this will be achieved because one and the same sensor unit, including a light receiver (sensor), which receives the light of at least one light emitter, is designed to control the two types of position accuracy (register and gage-pin).

This applies to the device, which is characterized by the fact that the sensor unit can be operated in two operating modes, for which at least two light emitters are available, whereby in one operating mode a transmission of light from the first light emitter to the light receiver is designed to pass through a transparent carrier or transparent transport band for the print substrate and the first light emitter and light receiver are arranged on different sides of the transparent carrier; in the other operating mode, the light from the second light emitter to the light receiver occurs through reflection and the second light emitter and the light receiver are arranged on the same side of the transparent carrier.

In another development of the invention, in order to attain reliable reflection properties for the two operating modes mentioned, a light reflector will be situated on the side of the carrier opposite to the second light emitter and light receiver. The first light emitter for the first operating mode is advantageously integrated into this light reflector. The second light emitter for the second operating mode is arranged in the area of the light receiver, preferably also integrated.

In another development of the invention a further control mechanism controls the operating modes of the sensor unit and for the evaluation of the data gained with the sensor in the two operating modes. The light receiver is preferably a color sensor, so that it can in particular recognize the differently colored color register marks equally well.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
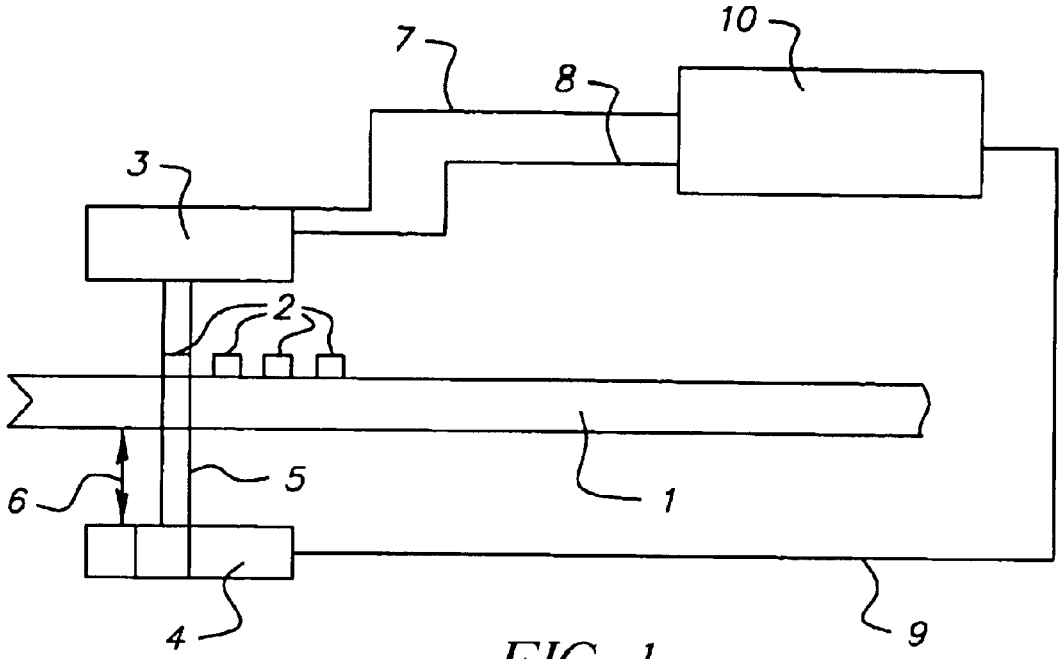
FIG. 1 is a device according to the invention, in schematic side view in an operating mode with reflection.

Referring now to the accompanying drawings, FIG. 1 shows in schematic side view, a device according to this invention in an operating mode with reflection. Color register marks 2 of toner arrive on a transport band 1 for the print substrate, which is transparent to light. The transport band 1 moves toward the left in the diagram for the transport of the print substrate.

Above the transport band 1, a sensor unit 3 has been situated, which includes one light emitter and one light receiver. A light reflector 4 has been arranged opposite the sensor unit 3 underneath the transport band 1, in which a second light emitter has been integrated.

In the operating mode depicted in FIG. 1, the light emitter in the sensor unit 3 emits light 5, which is reflected by the light reflector 4 and received by the light receiver in the sensor unit 3. This light path is symbolized by the double arrow 6. If a color register mark, as shown in FIG. 1, enters into the beam 5, then the light receiver in the sensor unit 3 is only able to receive less of the reflected light 5 or none at all. The interruption of the color register mark 2 is therefore localized in the area of the beam of light. The color register marks must not have the width of the light beam coincidentally selected in the diagram FIG. 1, but instead the beam of light 5 can be compressed more narrowly.

If the color register marks are situated on a print substrate, differently than depicted in the diagram, then no light 5 can get through the print substrate and the transport band, but instead is reflected by the print substrate itself to a greater degree than by the color register mark, so that the light receiver's method of action in the sensor unit 3 remains the same and the color register mark can likewise be localized in the light beam 5.

The sensor unit 3 is linked by a control line 7 for setting the selected operating mode and by a data line 8 for relay of the recorded data of the sensor unit 3 with a control unit 10. The control unit 10 is linked with the light reflector 4 and the light emitter integrated in this by a second control line 9, likewise for setting the relevant operating mode. In extreme cases, the control unit 10 can control the correction of the position accuracy attained with the received data by another line, which is not displayed in the diagram.

Figure 2:
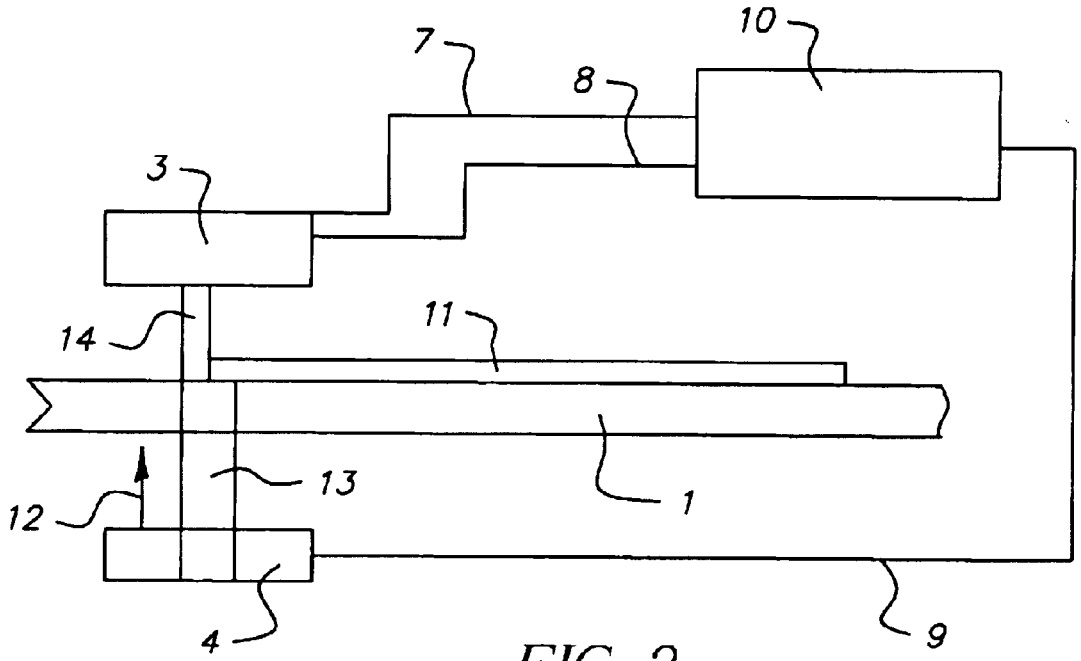
FIG. 2 is the device according to FIG. 1 in an operating mode with transmission.

FIG. 2 shows the device in an operating mode with transmission in the same representation according to FIG. 1. The same components are depicted with the same numbers as in FIG. 1. The difference to FIG. 1 is that a printed sheet 11 now lies on the transport band 1. Its front edge in the direction of the transport has passed into the working area of the sensor unit 3.

This time, the light reflector 4 cannot function and the light emitter integrated in the light reflector 4 is activated and emits a compressed beam of light 13 in the direction of the arrow 12 through the transport band 1 to the sensor unit 3.

The partial passing of the printed sheet 11 into the compressed beam of light 13 means that this is partially interrupted and only the partial beam of compressed light 14 is received by the light receiver of the sensor unit 3. This is recognized by the light receiver and relayed to the control unit 10 via the data line 8, so that the front edge is therefore localized in the area of the compressed light beam 13.

The invention has been described in detail with particular reference to certain preferred embodiments thereof, but it will be understood that variations and modifications can be effected within the spirit and scope of the invention.

What is claimed is:

1. Controlling the position accuracy in color printing with an electrophotographic printing device in regard to the register, namely the position accuracy of a printed image on the print substrate, in particular on the printed sheet regarding an edge of the printed sheet and in regard to the gage-pin, namely the position accuracy of the color printouts of the color print in relation to each other, comprising: a sensor unit (3) including a light receiver (sensor), which receives the light (5, 13, 14) of at least one light emitter, wherein register and gage-pin position accuracy are executed by one and the same sensor unit (3).

2. Controlling the position accuracy according to claim 1, wherein said sensor unit (3) can be operated in two operating modes, for which at least two light emitters are available, where in the one operating mode, light (13, 14) is transmitted from the first light emitter to the light receiver through a transparent carrier (transport band 1) for the print substrate (11) and the first light emitter and the light receiver are arranged on different sides of the transparent carrier; in the other operating mode, on the other hand, light (5) is reflected by the second light emitter to the light receiver and the second light emitter and the light receiver are arranged on the same side of the transparent carrier.

3. Device for controlling the position accuracy in color printing with an electrophotographic printing device in regard to the register, namely the position accuracy of a printed image on the print substrate, in particular on the printed sheet regarding an edge of the printed sheet and in regard to the gage-pin, namely the position accuracy of the color printouts of the color print in relation to each other, comprising: a sensor unit (3), including a light receiver, which receives light (5, 13, 14) of at least one light emitter wherein said one and the same sensor unit (3) controls the register and gage-pin position accuracy.

4. Device according to claim 3, wherein said sensor unit (3) can be operated in two operating modes, for which at least two light emitters are available, where in the one operating mode, light (13, 14) is transmitted from the first light emitter to the light receiver through a transparent carrier (transport band 1) for the print substrate (11) and the first light emitter and the light receiver are arranged on different sides of the transparent carrier; in the other operating mode, on the other hand, light (5) is reflected by the second light emitter to the light receiver and the second light emitter and the light receiver are arranged on the same side of the transparent carrier.

5. Device according to claim 4, wherein for the second operating mode mentioned, a light reflector (4) is situated opposite side of the carrier to the second light emitter and light receiver.

6. Device according to claim 5, wherein said first light emitter for the first operating mode is integrated into the light reflector (4).

7. Device according to claim 4, wherein second light emitter is arranged in the area of the light receiver for the second operating mode.

8. Device according to claim 4, further including a control unit (10) for the control of the operating modes of the sensor unit (3) and for the evaluation of the data attained with the sensor unit (3) in the two operating modes.

9. Device according to claim 4, wherein said light receiver is a color sensor.

* * * * *